United States Patent [19]

Mochida

[11] Patent Number: 4,935,778

[45] Date of Patent: Jun. 19, 1990

[54] ELECTROPHOTOGRAPHIC IMAGE FORMING APPARATUS WITH FLY WHEEL

[75] Inventor: Yoshinori Mochida, Kawasaki, Japan

[73] Assignee: Canon Kabushiki Kaisha, Tokyo, Japan

[21] Appl. No.: 138,963

[22] Filed: Dec. 29, 1987

[30] Foreign Application Priority Data

Jan. 19, 1987 [JP] Japan ..... 62-9450

[51] Int. Cl.[5] ..... G03G 15/00

[52] U.S. Cl. ..... 355/211; 346/160

[58] Field of Search ..... 355/3 R, 3 DR, 4, 3 TR, 355/200, 211; 346/153.1, 157, 160

[56] References Cited

U.S. PATENT DOCUMENTS 4,731,638 3/1988 Cherian ..... 355/3 DR X 4,737,821 4/1988 Suzuki et al. ..... 355/4

FOREIGN PATENT DOCUMENTS 56-137361 10/1981 Japan .

58-42985 9/1983 Japan .

60-250377 12/1985 Japan ..... 355/3 DR

*Primary Examiner*—Joan H. Pendegrass

*Attorney, Agent, or Firm*—Fitzpatrick, Cella, Harper & Scinto

[57] ABSTRACT

An electrophotographic image forming apparatus having a rotatable, electrophotographically-sensitive drum; a latent image forming device for forming an electrostatic latent image on the sensitive drum; a development device for developing the electrostatic latent image; a transfer drum for transferring a developed image to a transfer medium; a cleaning device for cleaning the sensitive drum after transfer; a driving-force source for driving and rotating the sensitive drum; and a fly-wheel provided as rotary inertial body and fixed to a shaft to which the sensitive drum is fixed.

13 Claims, 4 Drawing Sheets

ELECTROPHOTOGRAPHIC IMAGE FORMING APPARATUS WITH FLY WHEEL

BACKGROUND OF THE INVENTION

1. Field of the Invention

This invention relates to an apparatus for forming electrophotographic images.

2. Description of the Prior Art

In general, in an electrophotographic image forming apparatus such as a color copier or color printer, images of at least two different colors formed on an electrophotographically-sensitive medium are transferred to a transfer medium in a multi-transfer manner so that a color image can be obtained on the transfer medium.

Transfer methods used for this process are known, such as one in which a transfer medium supported on an electrically conductive roller is transported in synchronism with a sensitive medium while being pressed thereagainst and a bias voltage of a polarity reverse to that of the toner is applied to the roller so as transfer the toner image to the transfer medium, or one in which a transfer medium is transported in synchronism with a sensitive medium while being supported on a cylindrical drum and a bias voltage of a polarity reverse to that of the toner is applied to the reverse surface of the transfer medium roller so as to transfer the toner image to the transfer medium.

In either case, it is desired that the bias roller or cylindrical drum provided as a support for the transfer medium is rotated in complete synchronism with the speed at which the surface of the sensitive medium moves.

This is because failure to attain rotational synchronism between the transfer medium support and the sensitive medium causes distortions and fading on the image at the time of each toner image transfer, this finally appearing as errors in color distribution in the final image formed on the transfer medium. In the case of an ordinary monochrome copier, a defect of this kind that is comparatively low significance is not easy to perceive because of the monochromatic tone of the image. However, in the case of a color copier or color printer, a defect of the same sort is highly noticeable because it is perceived as a difference in color. In this case, it is necessary to guarantee the rotational synchronism between the transfer medium support and the sensitive medium.

On the other hand, to hold the transfer medium on the bias roller or the cylindrical drum, a transfer-medium gripping means (e.g., a gripper opened or closed by a cam) is used.

Conventionally, there is a problem arising from the impact that occurs when the gripper is opened or closed by the cam. This impact causes abrupt changes in the load imposed on the rotating means and, hence, changes in the speed of rotation of the rotary drum, thereby damaging the rotational synchronism of the rotary drum and the sensitive drum. This problem can be relieved to some extent by optimizing the shape of the cam, but the effect of such efforts is limited. In another possible approach, an inertial body which functions as a fly-wheel rotating integrally with the transfer drum without any rattling may be attached to the transfer drum.

However, the provision of a fly-wheel on the transfer drum in this manner involves the following problems.

There is a need for the provision of a mechanism which enables the transfer drum to be easily detached from the main body of the apparatus in order to remove the transfer medium when the apparatus detects an abnormality and stops while the transfer medium is held on the transfer drum (jam disposal), or in order to satisfy certain requirements for maintenance. The provision of a fly-wheel entails an increase in the weight of the transfer drum and an increase in the are occupied (volume), resulting in a considerable deterioration in operability.

There are types of exposure system that may be applied to image forming apparatus represented by the above-described color copier or color printer. Examples of such systems are a slit exposure system in which an original-scanning optical system and the sensitive drum are driven in synchronism with each other by using a mechanical link means such as a gear train, chain, or timing belt and the sensitive medium is exposed to the original image through lenses, and a line-scanning exposure system in which the sensitive medium is scanned with information light at a constant speed by an exposure means which uses a laser scanner and a liquid crystal shutter and which is disposed above the sensitive drum.

In either case, there are problems, which will be described below with reference to FIG. 4.

In an electrophotography apparatus shown in FIG. 4, a development sleeve 13*a* for supplying a developer to the sensitive drum 1 and a spacer roller 13*b* provided as a means for constantly maintaining a gap $\Delta l$ are in contact with the sensitive drum 1. Vibrations caused by a development device 13 are thereby transmitted to the sensitive drum, and the sensitive drum is vibrated (in the arrowed direction A in FIG. 4).

A cleaning blade 271 for removing untransferred toner is also in contact with the sensitive drum 1. This contact tends to cause vibrations of the blade, depending on the amount of toner remaining. These vibrations result in vibrations of the sensitive drum, as in the case of the development device.

Such vibrations of the sensitive drum act to cause non-uniformity of an image formed on the drum. In particular, in the case of the above-mentioned line-scanning exposure apparatus, vibration of the sensitive drum causes variations of the line interval (unevenness of the pitch), and changes in the image quality due to such exposure are more noticeable than those in a slit exposure apparatus. In the case of a line-scanning color printer, a deterioration in the image quality due to the above-described factors is particularly detrimental.

Moreover, vibration of the sensitive drum affects the transfer of a toner image from the sensitive drum to the transfer medium so as to cause errors in transfer matching, which, together with the above-mentioned unevenness of exposure, considerably reduces the quality of the image obtained.

On the other hand, vibrations which occur on the transfer drum as described above are also transmitted to the sensitive drum, thereby causing non-uniformity of the image at the time of the exposure which is performed in the above-described manner.

SUMMARY OF THE INVENTION

It is therefore an object of the present invention to provide an electrophotographic image forming apparatus which is capable of preventing the occurrence of image non-uniformity at the time of exposure.

It is another object of the present invention to provide an electrophotographic image forming apparatus which is capable of preventing non-uniformity of transfer.

It is another object of the present invention to provide an electrophotographic image forming apparatus which is capable of forming color images having improved image quality.

It is still another object of the present invention to provide a line-scanning exposure type of electrophotographic image forming apparatus which is capable of forming color images having improved image quality.

To these ends, the present invention provides an electrophotographic image forming apparatus having: a rotatable, electrophotographically-sensitive drum; a latent image forming means for forming an electrostatic latent image on the sensitive drum; a development means for developing the electrostatic latent image; a transfer means for transferring a developed image to a transfer medium; a cleaning means for cleaning the sensitive drum after transfer; a driving-force source for driving and rotating the sensitive drum; and a fly-wheel disposed at a position separate from that of the sensitive drum, the fly-wheel being mechanically connected to the sensitive drum so that the fly-wheel rotates in linked relationship with the sensitive drum.

Other objects and features of the present invention will become clear upon reading the following description.

DESCRIPTION OF THE PREFERRED EMBODIMENT

Figure 3:
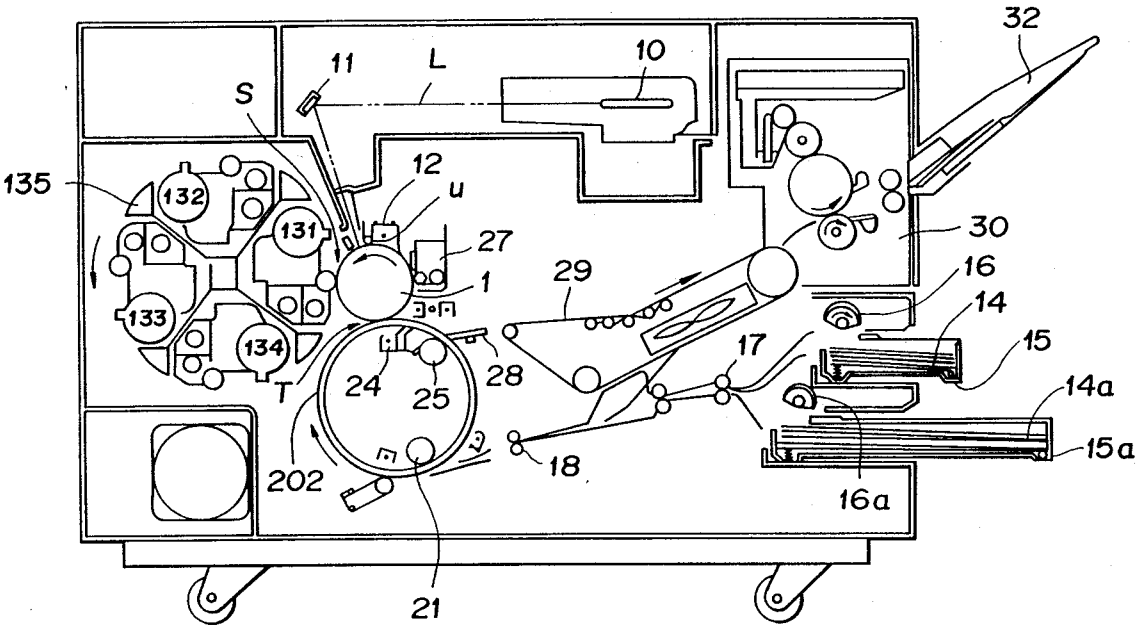
FIG. 3 is a schematic cross-sectional view of the whole body of a color image forming apparatus to which the mechanism shown in FIG. 1 is applied.

Referring to FIG. 3, a primary electrifying device 12, a development unit 135, transfer drum 202, cleaning device 27 are disposed around an electrophotographically-sensitive drum 1 which rotates counterclockwise.

The drum 1 which is electrified by the electrifying device 12 is subjected at a position u to scanning exposure using a laser beam L which is modulated in response to signals representing an image to be recorded, thereby forming an electrostatic latent image on the drum 1. An exposure means is provided with a scanner 10 such as a rotary polygon mirror for modulating the laser beam L, and a mirror 11 for reflecting the laser beam L toward the drum. The beam L is moved in a line scanning manner in the direction of intersection with the direction in which the drum 1 rotates. The recording image signals are obtained by converting an optical image of an original into electric signals by a photoelectric-conversion image sensor such as a CCD. Otherwise, the image signals may be signals supplied from a computer. Preferably, the sensitive drum 1 is successively exposed by a laser beam modulated by signals corresponding to a blue image, a laser beam modulated by signals corresponding to a green image, a laser beam modulated by signals corresponding to a red image, and a laser beam modulated by signals corresponding to a black image.

An electrostatic latent image formed in this manner is developed by the color development unit 135 which is provided with development devices 131, 132, 133, and 134 adapted to supply a yellow developer, a magenta developer, a cyan developer, and a black developer to the drum 1 at a development position S. Each development device is similar to the development device 13 shown in FIG. 4. The development unit 135 is of a rotary type and, when it rotates, one of the developement devices corresponding to a selected color is moved to the position S. Developed images of different colors are successively formed on the sensitive drum 1.

The developed images (toner image) on the sensitive drum 1 are transferred in a transfer section T by corona discharge effected by an electrifying device 24 onto a transfer medium 14 or **14*a* supported on a transfer drum 202 which is rotating clockwise. After transfer, developer (toner) remaining on the sensitive drum 1 is removed by a cleaning device 2 (refer to FIG. 4**).

The transfer medium 14 or **14*a* are taken out from a cassette 15 or 15*a* by a roller 16 or 16*a*, passes through the nip between a pair of rollers 17, and abuts against the nip between a pair of register rollers. The transfer medium is thereafter transported in synchronism with the rotation of the transfer drum 202, and is brought into abutment at its leading end against grippers 203 disposed on the transfer drum (refer to FIG. 2) and opened by a gripper cam 21. The leading end of the medium is pinched by the grippers 203 when the grippers 203 passes over the gripper cam 21. The transfer drum 202** rotates a plurality of times while supporting the transfer medium, and, during this rotation, the developed images of the different colors are transferred onto the same transfer medium by being superposed each other.

After transfer of the desired times, the transfer medium 14 or **14*a* is detached by detachment blade 28 from the grippers 203 which are opened by a detachment cam 25, and is transported through a transporting section 29 and a fixing section 30, finally being discharged to an external tray 32**.

The operation of driving the sensitive drum 1 and the transfer drum 202 in the above process will be described below with reference to FIGS. 1 and 2.

The driving force of a driving motor 101 is transmitted through a small gear 102 fixed to the motor shaft and relay gear 103 to a driving gear 105 which is fixed to a sensitive-drum shaft 104 by a screw 111. The sensitive-drum shaft 104 is rotatably supported at its far ends by bearings 106 and 107 and is smoothly rotated by receiving the rotary-drive force of the motor 101.

The sensitive drum 1 is provided with a cylinder 108 having on its surface an electrophotographically-sensitive layer, and flanges 109 and 110 which are fixed to the opposite ends of the cylinder 108 and which are fitted around the shaft 104. Both or one of the flanges 109 and 110 is fixed to the shaft by a screw 112, thereby enabling the drum 1 to rotate integrally with the shaft 104.

A gear 113 is integrally formed on the flange 110, that is, it is fixed relative to the drum 1. The gear 113 engages with a gear 114 which is fixed to one end of the transfer drum 202. This enables the transfer drum 202 to rotate in a linked relationship with the sensitive drum 1 while the driving force of the motor 101 is being transmitted from the gear 113 to the gear 114. The gear 113 has a pitch circle of substantially the same diameter as that of the outer circumference of the drum 1, and the gear 114 has a pitch circle of substantially the same diameter as that of the outer circumference of the drum 202, so that the sensitive drum 1, the transfer drum 202 and the transfer medium supported on the transfer drum 202 rotate at substantially the same peripheral speed. The transfer drum 202 is composed of opposite cylindrical members 207 and 207*a*, a member 208 which connects the cylindrical members 207 and 207*a*, and the transfer drum gear 114 disposed on the side of the cylindrical member 207*a*. The several numbers of grippers 203 are disposed on the interconnecting portion 208, and a cylindrical mesh or plastic sheet 209 around which the transfer medium is wound and supported is stretched between the cylindrical members 207 and 207*a*. The transfer-electrification device 24 supplies the transfer medium with transfer corona charge from the rear side thereof (inside of the drum).

One end of the transfer drum 202 is supported by a shaft 204 on a sub side plate 206, and the other end is rotatably supported by a plurality of rollers 205 on a sub side plate 206*a*. The transfer drum 202 is swingable together with the sub side plates 206 and 206*a* and is pressed against the sensitive drum 1 by the force of a spring (not shown).

Figure 1:
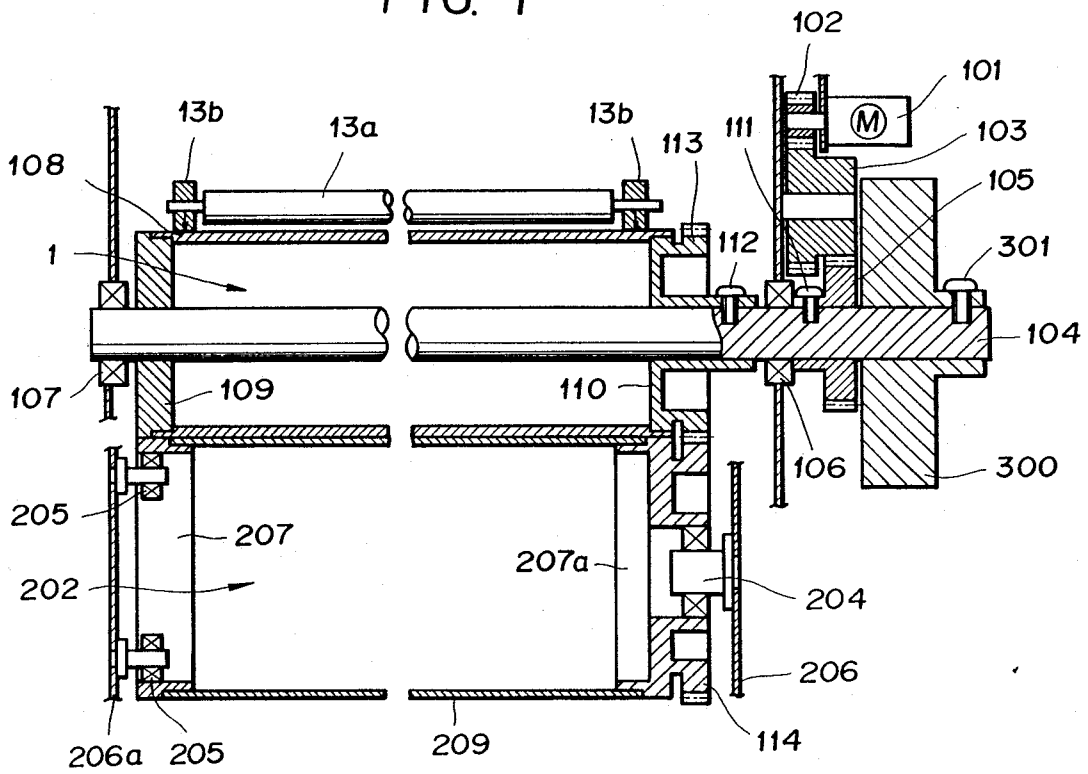
FIG. 1 is a cross-sectional view of an essential part of the structure of an image forming apparatus which represents an embodiment of the present invention.
Figure 2:
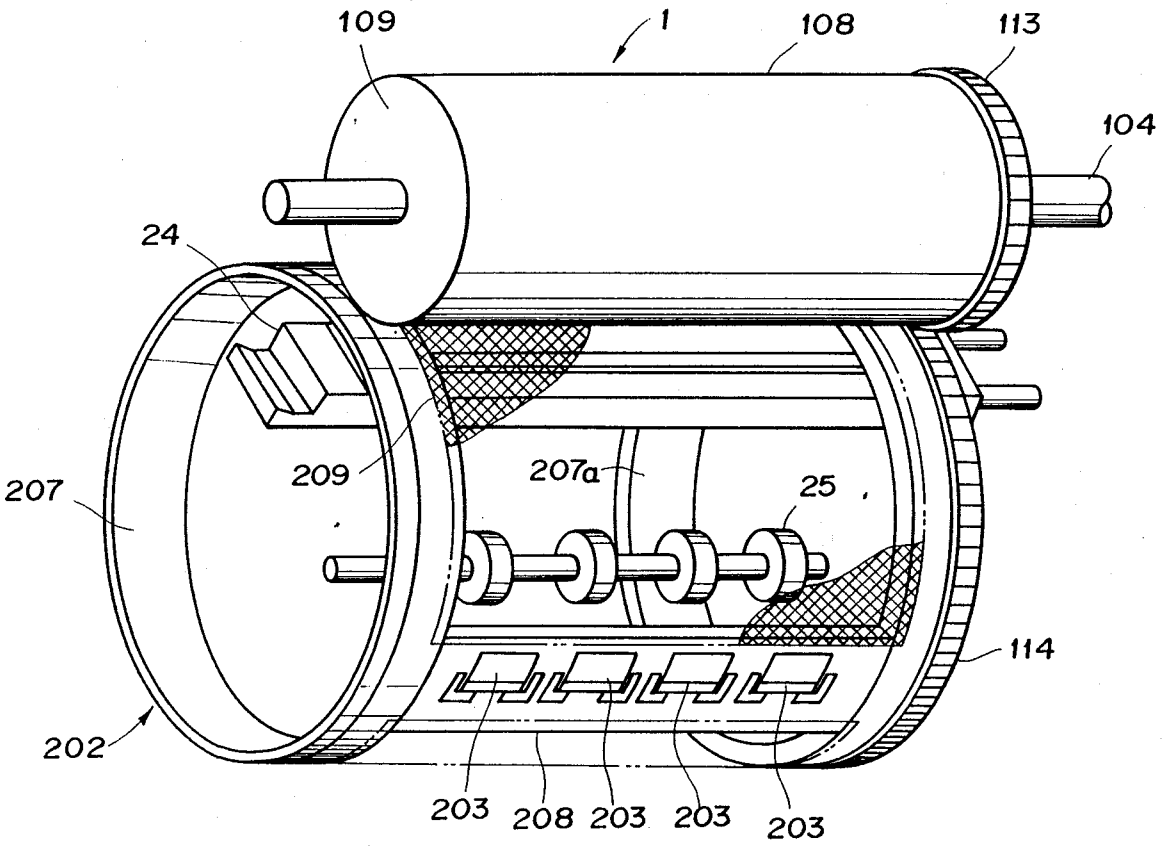
FIG. 2 is a schematic perspective view of the structure including a sensitive drum and a transfer drum.

A fly-wheel 300 shown in FIG. 1 is a disk-like, rotary, inertial body which is fixed to the sensitive-drum shaft 104 by a screw 301 without any play. Therefore, the fly-wheel 300 rotates together with the drum 1 and, hence, in a linked relationship with the drum 202. During normal rotation, the fly-wheel 300 receives the driving force transmitted from the motor 101 via the gear train 102, 103, and 105 and accumulates it as kinetic energy.

When the grippers 203 of the transfer drum 202 strikes on the gripper cam 21 or 25 which are means for opening the grippers, the transfer drum 202 receives a torque in the direction opposite to that of its rotation so that the rotational speed of the transfer drum 202 tends to decrease. At this time, the fly-wheel 300 releases the kinetic energy to supply a driving force to the transfer drum 202 through the sensitive-drum shaft 104, the sensitive drum gear 113 and the transfer drum gear 114. This function prevents a reduction in the speed at which the transfer drum 202 rotates, thereby enabling a constant rotational speed thereof. This mechanism enables the same effect as that realized by the provision of a fly-wheel on the rotary shaft of the transfer drum and is free from reduction in the operability of the transfer drum at the time of jam disposal. When the grippers 203 are opened or closed, the fluctuation of the speed of the transfer drum 202 is limited by the operation of the fly-wheel 300. Therefore, it is, of course, possible to limit the fluctuation of the speed of the sensitive drum 1 due to the fluctuation of the transfer drum speed.

Figure 4:
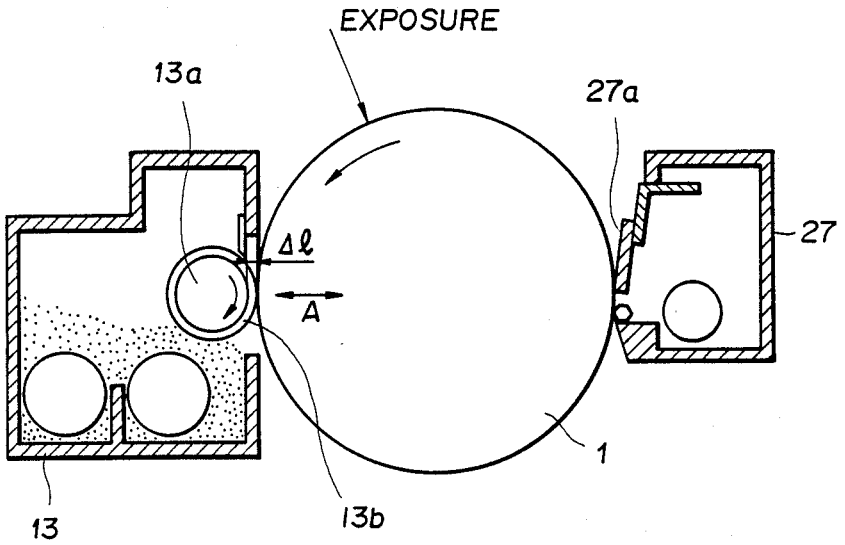
FIG. 4 is an illustration provided for the purpose of explaining vibrations to which the sensitive drum is subjected.

There is a possibility of the sensitive drum 1 being vibrated in a manner similar to that in the case of the conventional example in which the drum 1 is vibrated in the arrowed directions A in FIG. 4 by the development device 13 through the medium of the roller 13*b* coaxial with the development sleeve 13*a*. At the same time, the cleaning blade also vibrates. In the case of the conventional apparatus, as described above, such vibrations cause unevenness of the pitch of scanning lines at the exposure position and unevenness of transfer at the transfer position, as described above.

However, the sensitive drum 1 is integrally connected to the fly-wheel 300 by the sensitive-drum shaft 104 without any play so that these three members form a dynamically rigid body of a large mass. Therefore, the sensitive medium does not vibrate at any substantial amplitude. The vibration energy is independent of whether or not the fly-wheel is provided, but the degree or amplitude of vibration of the sensitive-drum system including the sensitive drum, the sensitive-drum shaft, and the fly-wheel decreases as the mass of the system increases. It is therefore possible to prevent unevenness of the scanning line pitch or transfer by adding the fly-wheel 300 or a rotary inertial body having a suitable mass, thereby greatly reducing such vibrations.

As described above, problems of the conventional technique can be solved by attaching a fly-wheel to the shaft of the sensitive drum. However, the optimum mass and moment of inertia of the fly-wheel vary depending upon the construction of the apparatus since they should be determined from the vibrating force of the development unit, the degree of vibration due to sliding of the cleaning blade on the drum surface, the degree of vibration of the transfer drum in response to the operation of opening or closing the grippers, the weight of each drum, and so forth.

In an example in accordance with the above-described embodiment, the weight of the sensitive-drum system (including the sensitive drum, the wheel, and the shaft) is 8 kg, and the moment of inertia is 2700 kg $cm^2$. It seems that the occurrence of vibrations of the above-described kind is considerable if the weight of the sensitive drum is smaller than about 2 kg. In the case of a transfer device having such a light sensitive drum, it is effective to use a fly-wheel so as to increase the mass as described above. Preferably, the weight of the fly-wheel is set to be higher than that of the sensitive drum, for example, 2 times or more, more preferably 6 to 7 times higher than the total weight of the sensitive drum including the shaft. This setting ensures good results. Of course, these conditions are changed depending on the rotational speed of the sensitive drum and the scanning line pitch.

In the above-described embodiment, the gear 105 fixed to the shaft 104 is used to transmit the driving force of the motor to the shaft 104, but the driving force of the motor may be directly transmitted to the gear 113 or the gear 114 by removing the gear 105.

The present invention can also be applied to other types of apparatus including a line scanning type of color electrophotography apparatus in which a light emitting diode array and a liquid crystal shutter array are used as means for performing exposure using image-information light, a slit exposure type of color electrophotography apparatus in which the sensitive drum is directly exposed to the original image which is not converted into electrical signals, and a monochrome type of electrophotography apparatus.

What is claimed is:

1. An electrophotographic image forming apparatus comprising:

a rotatable, electrophotographically-sensitive drum;

latent image forming means for forming an electrostatic latent image on said sensitive drum;

development means for developing said electrostatic latent image;

transfer means for transferring a developed image to a transfer medium;

cleaning means for cleaning said sensitive drum after transfer;

a driving-force source for driving and rotating said sensitive drum; and a fly-wheel disposed at a position separate from that of said sensitive drum, the weight of said fly-wheel being greater than that of said sensitive drum, said fly-wheel being mechanically connected to said sensitive drum so that said fly-wheel rotates in a linked relationship with said sensitive drum.

2. An electrophotographic image forming apparatus according to claim 1, further comprising a rotary shaft to which said sensitive drum is fixed, wherein said fly-wheel is fixed to said shaft and rotates while being coaxial with said sensitive drum.

3. An electrophotographic image forming apparatus according to claim 1 or 2, wherein said latent image forming means includes an exposure means for scanning in a line scanning manner said sensitive drum with light modulated in response to a signal representing information on an image to be recorded.

4. An electrophotographic image forming apparatus according to claim 3, wherein said development means includes a plurality of development devices for supplying developers of different colors to said sensitive drum.

5. An electrophotographic image forming apparatus according to claim 4, wherein said transfer means includes a transfer drum which is repeatedly rotated while supporting a transfer medium in order to successively transfer a plurality of developed images of different colors to the same transfer medium.

6. An electrophotographic image forming apparatus according to claim 5, further comprising a first gear fixed to said sensitive drum, and a second gear fixed to said transfer drum, said first and second gear engaging with each other.

7. An electrophotographic image forming apparatus comprising:

a rotatable, electrophotographically-sensitive drum;

exposure means for scanning said sensitive drum with a laser beam modulated in response to a signal representing information on an image to be recorded, thereby forming an electrostatic latent image;

a plurality of development devices for supplying developers of different colors to said sensitive drum;

transfer means for successively transferring a plurality of developed images of different colors to the same transfer medium, said transfer means including a transfer drum which rotates while supporting said transfer medium, gripper means provided on said transfer drum and adapted for gripping said transfer medium, and an operating means for opening or closing said gripper means;

a driving-force source;

a gear train for transmitting the driving force from said driving-force source to said sensitive drum;

a first gear fixed to said sensitive drum;

a second gear fixed to said transfer drum, said second gear being in engagement with said first gear;

a fly-wheel disposed at a position separate from that of said sensitive drum, the weight of said fly-wheel being greater than that of said sensitive drum, said fly-wheel being mechanically connected to said sensitive drum so that said fly-wheel rotates in a linked relationship with said sensitive drum.

8. An electrophotographic image forming apparatus according to claim 7, further comprising a rotary shaft to which said sensitive drum is fixed, wherein said fly-wheel is fixed to said shaft and rotates while being coaxial with said sensitive drum.

9. An electrophotographic image forming apparatus comprising:

a rotatable, electrophotographically-sensitive member;

latent image forming means for forming an electrostatic latent image on said sensitive member in response to color components;

developing means for developing said electrostatic latent image, said developing means including plurality of developing devices for supplying developers corresponding to the color components to said sensitive member;

transfer means for transferring a developed image to a transfer medium, said transfer means including a transfer medium supporting member which moves while supporting said transfer medium for bearing said transfer medium to a transfer position;

a driving-force source for driving said sensitive member;

an inertial member mechanically connected to but disposed at a position separate from said sensitive member, wherein the weight of said inertial member is greater than that of said sensitive member.

10. An electrophotographic image forming apparatus according to claim 9, wherein said latent image forming means includes means for forming said latent image on said sensitive member by scanning light along a scanning line.

11. An electrophotographic image forming apparatus according to claim 10, wherein said latent image forming means includes means for scanning said sensitive member with a laser beam modulated in response to image signals.

12. An electrophotographic image forming apparatus comprising:

a rotatable, electrophotographically-sensitive member;

latent image forming means for forming an electrostatic latent image on said sensitive member by scanning light along a scanning line;

developing means for developing said electrostatic latent image;

transfer means for transferring a developed image to a transfer medium;

a driving-force source for driving said sensitive member;

an inertial member mechanically connected to but disposed at a position separate from said sensitive member, the weight of said inertial member being greater than that of said sensitive member.

13. An electrophotographic image forming apparatus according to claim 12, wherein said latent image forming means includes means for scanning said sensitive member with a laser beam modulated in response to image signals.

* * * * *

UNITED STATES PATENT AND TRADEMARK OFFICE

CERTIFICATE OF CORRECTION

PATENT NO. : 4,935,778

DATED : June 19, 1990

INVENTOR(S) : YOSHINORI MOCHIDA

It is certified that error appears in the above-identified patent and that said Letters Patent is hereby corrected as shown below:

COLUMN 2

Line 7, "are" should read --area--.

COLUMN 4

Line 23, "are" should read --is--.
Line 33, "passes" should read --pass--.
Line 37, "superposed" should read --superposed on--.

COLUMN 5

Line 38, "strikes" should read --strike--.

COLUMN 7

Line 35, "first and second gear" should read --first and second gears--.

UNITED STATES PATENT AND TRADEMARK OFFICE

CERTIFICATE OF CORRECTION

PATENT NO. : 4,935,778

DATED : June 19, 1990

INVENTOR(S) : YOSHINORI MOCHIDA

It is certified that error appears in the above-identified patent and that said Letters Patent is hereby corrected as shown below:

COLUMN 8

Line 27, "ber;" should read --ber; and--.
Line 54, "ber;" should read --ber; and--.

Signed and Sealed this

Twenty-fifth Day of August, 1992

*Attest:*

DOUGLAS B. COMER

*Attesting Officer*

*Acting Commissioner of Patents and Trademarks*